US011415358B1

(12) United States Patent
Jackson et al.

(10) Patent No.: US 11,415,358 B1
(45) Date of Patent: Aug. 16, 2022

(54) ADAPTIVE PERIMETER HEATING IN REFRIGERATOR AND FREEZER UNITS

(71) Applicant: ILLINOIS TOOL WORKS INC., Glenview, IL (US)

(72) Inventors: Steven T. Jackson, Fort Worth, TX (US); Charles M. Louis, Fort Worth, TX (US); Joseph F. Sanders, North Richland Hills, TX (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 483 days.

(21) Appl. No.: 16/446,770

(22) Filed: Jun. 20, 2019

(51) Int. Cl.

| | |
|---|---|
| ***F25D 21/04*** | (2006.01) |
| ***F25D 11/02*** | (2006.01) |
| ***F25D 21/08*** | (2006.01) |
| ***F25D 21/00*** | (2006.01) |

(52) U.S. Cl.
CPC ..... *F25D 21/04* (2013.01); *F25D 11/02* (2013.01); *F25D 21/004* (2013.01); *F25D 21/08* (2013.01)

(58) Field of Classification Search
CPC ..... F25D 21/04; F25D 21/08; F25D 21/006
See application file for complete search history.

(56) References Cited

U.S. PATENT DOCUMENTS

| | | | | |
|---|---|---|---|---|
| 3,707,851 | A | | 1/1973 | McAshan, Jr. |
| 3,736,765 | A | | 6/1973 | O'Dell |
| 4,327,557 | A | | 5/1982 | Clarke et al. |
| 4,432,211 | A | * | 2/1984 | Oishi ..... G05D 23/2401 62/155 |
| 4,481,785 | A | | 11/1984 | Tershak |
| 4,485,633 | A | | 12/1984 | King |
| 4,487,030 | A | | 12/1984 | Carter et al. |
| 4,553,400 | A | | 11/1985 | Branz |
| 4,689,965 | A | | 9/1987 | Janke et al. |
| 4,821,530 | A | | 4/1989 | Ledbetter |
| 4,843,833 | A | | 7/1989 | Polkinghorne |
| 4,855,567 | A | | 8/1989 | Mueller |
| 5,237,830 | A | | 8/1993 | Grant |
| 5,271,236 | A | | 12/1993 | Sweetser |

(Continued)

FOREIGN PATENT DOCUMENTS

| | | |
|---|---|---|
| EP | 2711654 | 3/2014 |
| JP | 2014 020715 | 2/2014 |

*Primary Examiner* — Nelson J Nieves
*Assistant Examiner* — Meraj A Shaikh
(74) *Attorney, Agent, or Firm* — Thompson Hine LLP

(57) ABSTRACT

A method, and related refrigerated device, is provided for controlling a heater element of a refrigerated device having a compartment including an access door engageable with a perimeter of a compartment opening when the door is closed and a refrigeration circuit for cooling the compartment to a set point temperature, wherein the heater element heats a surface of the perimeter of the compartment opening to inhibit formation of condensation on the surface. The method involves: determining a temperature and relative humidity of ambient air surrounding the refrigerated device; determining a dew point temperature of the ambient air based upon the temperature and the relative humidity of the ambient air; and defining an energization level for the heater element based at least in part upon each of (i) the determined dew point temperature, (ii) the temperature of the ambient air and (iii) the set point temperature of the compartment.

12 Claims, 3 Drawing Sheets

(56) References Cited

U.S. PATENT DOCUMENTS

| | | | |
|---|---|---|---|
| 5,275,009 | A | 1/1994 | Kobayashi et al. |
| 5,442,933 | A | 8/1995 | Unger |
| 5,460,010 | A | 10/1995 | Kobayashi et al. |
| 5,473,911 | A | 12/1995 | Unger |
| 5,474,213 | A | 12/1995 | Unger |
| 5,483,804 | A | 1/1996 | Ogawa et al. |
| 5,524,445 | A | 6/1996 | Morrow et al. |
| 5,526,854 | A | 6/1996 | Unger |
| 5,564,286 | A | 10/1996 | Suse |
| 5,600,966 | A | 2/1997 | Valence et al. |
| 5,692,385 | A | 12/1997 | Hollenbeck et al. |
| 5,737,939 | A | 4/1998 | Valence et al. |
| 5,765,382 | A | 6/1998 | Manning et al. |
| 5,813,242 | A | 9/1998 | Lawrence et al. |
| 5,887,443 | A | 3/1999 | Lee et al. |
| 5,934,087 | A | 8/1999 | Watanabe et al. |
| 6,036,294 | A | 3/2000 | Banicevic et al. |
| 6,085,530 | A | 7/2000 | Barito |
| 6,131,400 | A | 10/2000 | Seol et al. |
| 6,226,995 | B1 | 5/2001 | Kalempa et al. |
| 6,408,636 | B1 | 6/2002 | Backes et al. |
| 6,477,849 | B2 | 11/2002 | Butts et al. |
| 6,868,678 | B2 | 3/2005 | Mei et al. |
| 6,868,688 | B2 | 3/2005 | Narehood |
| 6,912,860 | B2 | 7/2005 | Zima et al. |
| 7,003,967 | B2 | 2/2006 | Rafalovich et al. |
| 7,062,928 | B2 | 6/2006 | Karlsson et al. |
| 7,082,380 | B2 | 7/2006 | Wiebe et al. |
| 7,275,379 | B2 | 10/2007 | Zeng |
| 7,548,170 | B1 | 6/2009 | Griffel et al. |
| 7,819,331 | B2 | 10/2010 | Arneson |
| 8,978,467 | B2 | 3/2015 | Wagner et al. |
| 9,086,233 | B2 | 7/2015 | Chun et al. |
| 2005/0268627 | A1 | 12/2005 | Vogh |
| 2007/0006604 | A1 | 1/2007 | Behr |
| 2009/0090114 | A1 | 4/2009 | Choo |
| 2012/0047919 | A1 | 3/2012 | Besore |
| 2017/0030628 | A1* | 2/2017 | Sanders ..... F25D 21/04 |
| 2020/0191464 | A1* | 6/2020 | Avhale ..... F25D 23/028 |

* cited by examiner

ADAPTIVE PERIMETER HEATING IN REFRIGERATOR AND FREEZER UNITS

TECHNICAL FIELD

This application relates generally to refrigerator and freezer units and, more specifically, to a control system for controlling cabinet perimeter heating in a refrigerator or freezer unit to inhibit condensation.

BACKGROUND

The operating environment of a refrigerated device, such as a refrigerator or freezer unit, greatly influences its performance. Temperature and humidity affect runtimes, set point and other dynamically calculated parameters.

In this regard, the area around the door gasket on the outside of the cabinet is metal, typically aluminum or stainless steel. In a cabinet where the inside materials, as well as the breaker strips, are metal, conduction of heat from the outside to the inside occurs. As a result, the metal surface around the door is typically much cooler than the ambient temperature. If the temperature of the metal around the door gasket drops low enough, condensation will form. If enough condensation forms, it can drip on the floor. The temperature at which condensation forms is the dew point temperature, which depends on the dry bulb temperature and the relative humidity.

To prevent condensation from forming, perimeter heaters are installed on commercial refrigerator and freezer units. A typical industry strategy is to activate the perimeter heaters whenever the compressor cycles on, and deactivate them when the compressor turns off. This approach works well in many environments, but in low temperature environments with high humidity, the low runtime of the compressor (resulting in an equally low runtime of the perimeter heater) may not prevent condensation. In a dry environment, the door heater may not need to run as much, wasting energy.

U.S. Patent Publication 2017/0030628 discloses units having a built-in relative humidity (RH) sensor which measures relative humidity and ambient temperature of the environment where the unit is operating. Using the relative humidity and ambient temperature, the dew point temperature is calculated. The dew point temperature is used in a number of control algorithms, including cabinet perimeter heater control.

U.S. Patent Publication 2017/0030628 represents a more dynamic control for the perimeter heaters that takes into account the dew point temperature by establishing different control logic for the perimeter heaters based upon actual operating conditions by identifying a region of operation according to a psychrometric chart. For example, if the unit is operating in conditions of very high humidity (as represented by a region on the psychrometric chart), the perimeter heaters may be turned on constantly. Conversely, if the unit is operating in conditions of very low humidity (as represented by another region on the psychrometric chart), the perimeter heaters may be turned off or set to some minimum heater duty cycle. If the unit is operating in conditions of moderate humidity (as represented by a middle region on the psychrometric chart (e.g., Region 2 in FIG. 2 of U.S. Patent Publication 2017/0030628), then the control system may calculate a perimeter heater duty cycle that is appropriate for preventing condensation. The duty cycle algorithm is continuously employed, where the perimeter heater is turned on for a number of seconds and then turned off for a number of seconds.

The prior art system of U.S. Patent Publication 2017/0030628 has been implemented to calculate the door heater duty cycle (DHDutyCycle) via a calculation based upon the upper dew point temperature that bounds Region 2 (DPUpper), the lower dew point temperature that bounds Region 2 (DPLower), and the actual dew point temperature of the surrounding environment (DPRoomActual), per the following equation:

$$DHDutyCycle=(DPRoomActual-DPLower)/(DPUpper-DPLower) \quad (1)$$

The DPLower and DPUpper values for any given refrigerated device are predefined in memory of the device controller based upon testing of the refrigerated device type or model, with the testing taking place at a reference ambient temperature and a reference cabinet set point temperature (e.g., 75° F. ambient, and −3° F. cabinet set point for a freezer).

This implementation of U.S. Patent Publication 2017/0030628 has proven effective, but improvements are regularly sought.

SUMMARY

In one aspect, a refrigerated device includes a compartment including an access door engageable with a perimeter of a compartment opening when the door is closed, and a cooling system for cooling the compartment to a set point temperature. At least one sensor provides an output indicative of a temperature and relative humidity of ambient air that surrounds the compartment. At least one heater element is associated with the perimeter of the compartment opening. A controller is operatively connected with the at least one sensor, the cooling system and the at least one heater, wherein the controller is configured to: determine a dew point temperature of the ambient air based on the temperature and the relative humidity of the ambient air; and define an energization level for the at least one heater element based at least in part upon each of (i) the determined dew point temperature, (ii) the temperature of the ambient air and (iii) the set point temperature of the compartment.

In another aspect, a refrigerated device includes a compartment including an access door engageable with a perimeter of a compartment opening when the door is closed, and a cooling system for cooling the compartment to a set point temperature. At least one sensor provides an output indicative of a temperature and relative humidity of ambient air that surrounds the compartment. At least one heater element is associated with the perimeter of the compartment opening. A controller is operatively connected with the at least one sensor, the cooling system and the at least one heater, wherein the controller is configured to define an energization level for the at least one heater element based at least in part upon the set point temperature of the compartment.

The details of one or more embodiments are set forth in the accompanying drawings and the description below. Other features, objects, and advantages will be apparent from the description and drawings, and from the claims.

DETAILED DESCRIPTION

Figure 1:
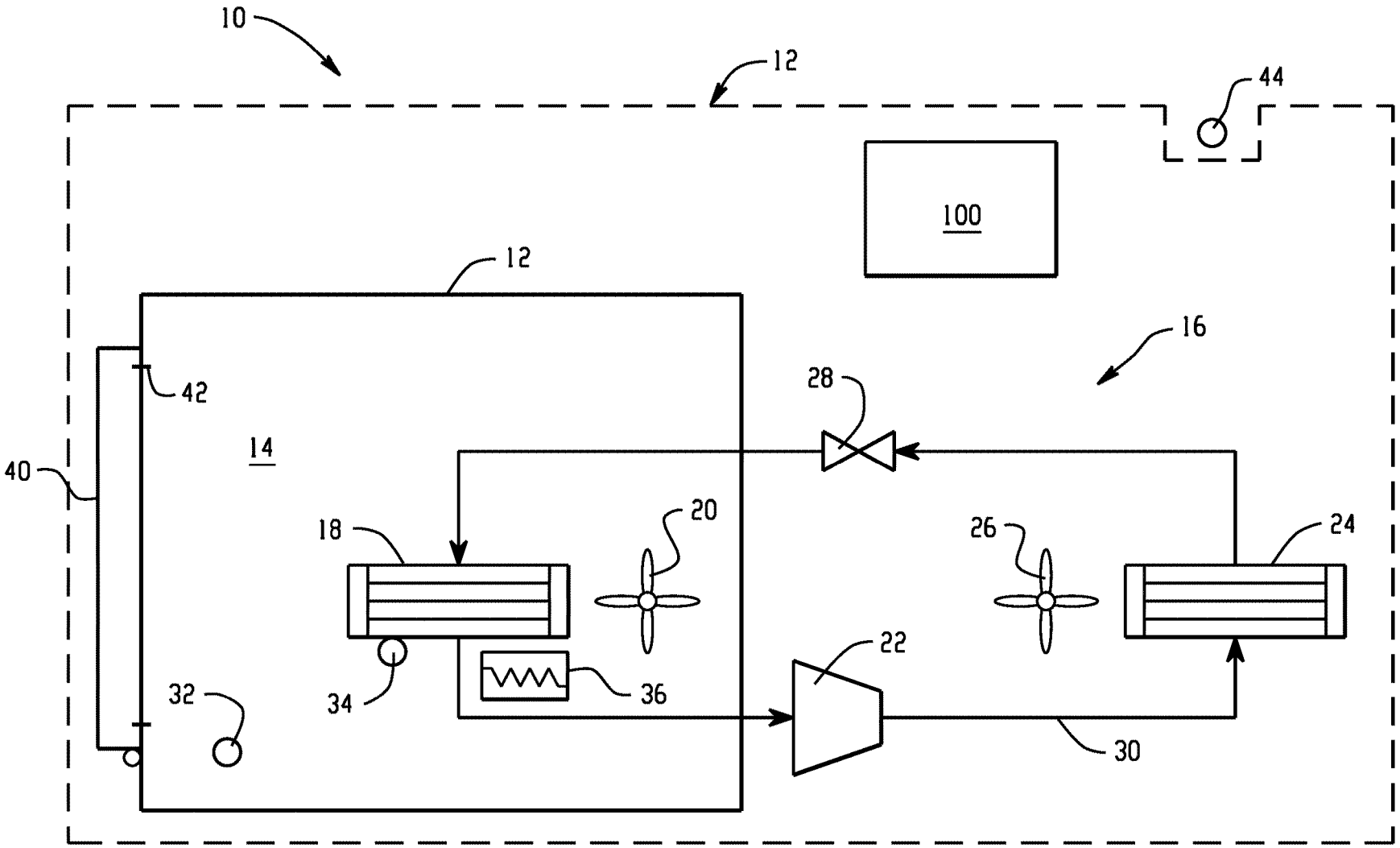
FIG. 1 is a schematic depiction of a refrigerated device.

Referring to FIG. 1, a refrigerated device 10, such as refrigerated cabinet (e.g., refrigerator, freezer, refrigerator/freezer combination, refrigerated display case, etc.) is shown, where a cabinet housing 12 defines a refrigerated space or compartment 14 that is cooled by a refrigeration system 16 that includes an evaporator 18 and associated fan 20, a compressor 22, a condenser 24, an associated fan 26 and an expansion device 28, all located along a path 30 of refrigerant medium. An evaporator temperature sensor 34 may be installed in the fins of the evaporator, or in any other location likely to accumulate frost and ice during use of the cabinet. A cabinet temperature sensor 32 can be installed inside the compartment 14, or in the return air duct that circulates past the evaporator 18, or in any location within the refrigerated space that will serve as the basis for controlling the refrigeration system to cool the space to a set point temperature.

Figure 2:
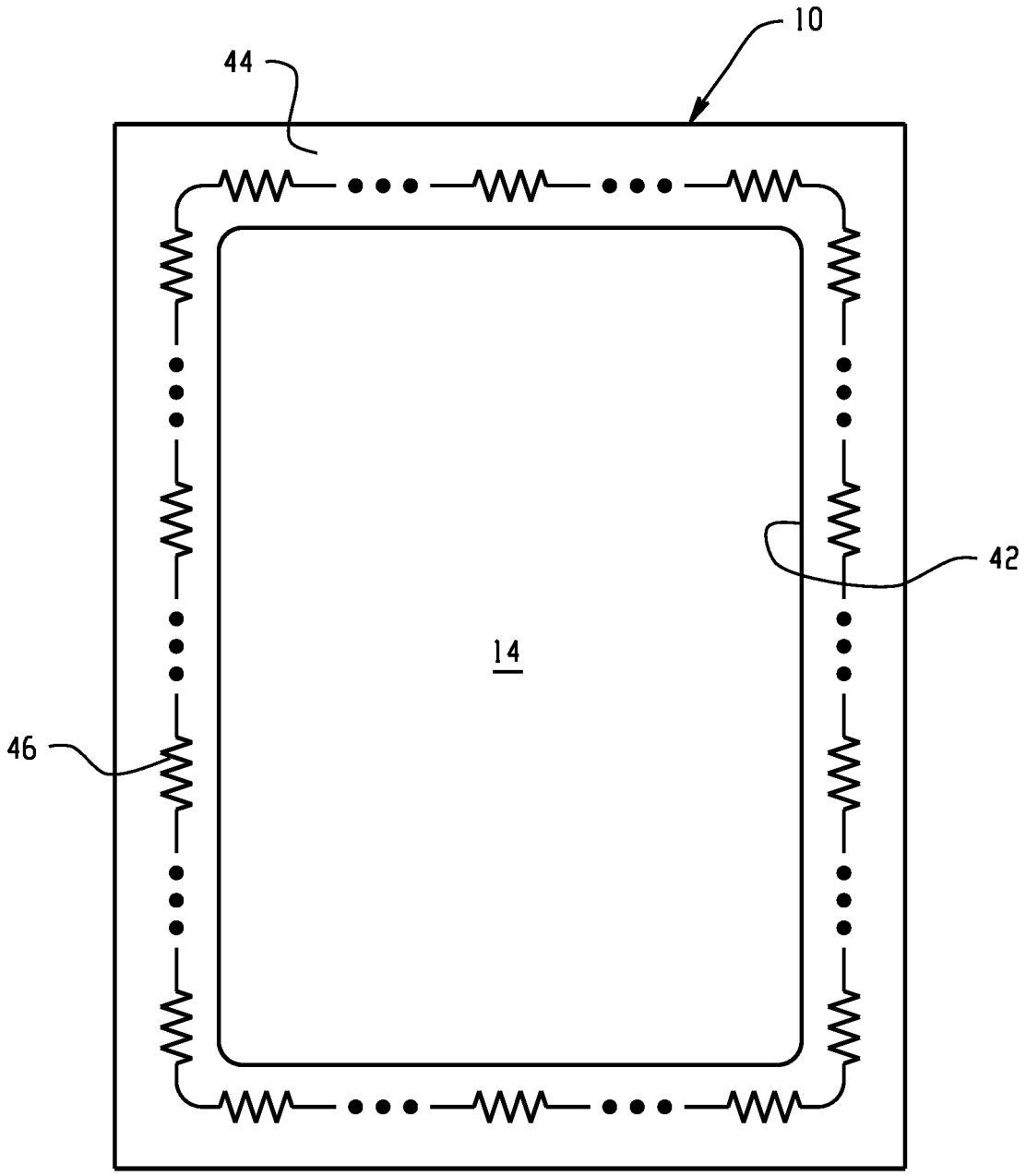
FIG. 2 is a front schematic view of the refrigerated device showing heater element(s) around the perimeter of the opening to the refrigerated device compartment.

The device 10 includes a door 40 that is movable between the illustrated closed position and an open position relative to an opening 42 that is used to access the compartment 14. As seen is FIG. 2, a perimeter portion 44 of the cabinet around the opening 42 to the compartment 14 includes one or more resistive heating elements 46 that are located beneath the metal skin of the perimeter portion and positioned so that the heater element(s) will heat the surface of the metal skin in order to inhibit condensation.

The system also includes a heat source 36 for selectively applying heat to the evaporator 18 for defrost purposes, and an ambient air sensor 44 positioned within an ambient environment where the refrigerated device 10 is located. The ambient air sensor 44 may be used for generating a signal indicative of both a dry bulb temperature (DB temperature) as well as a relative humidity (RH) of ambient air that surrounds the cooled compartment 14. Although a single sensor is illustrated, it is to be appreciated that separate sensors may be used.

The refrigerated device 10 also includes a controller 100 operatively connected to the sensors for receiving sensor outputs and to the components for control thereof. The controller may take on various forms, incorporating electrical and electronic circuitry and/or other components. As used herein, the term controller is intended to broadly encompass any circuit (e.g., solid state, application specific integrated circuit (ASIC), an electronic circuit, a combinational logic circuit, a field programmable gate array (FPGA)), processor(s) (e.g., shared, dedicated, or group—including hardware or software that executes code), software, firmware and/or other components, or a combination of some or all of the above, that carries out the control functions of the device or the control functions of any component thereof.

Figure 3:
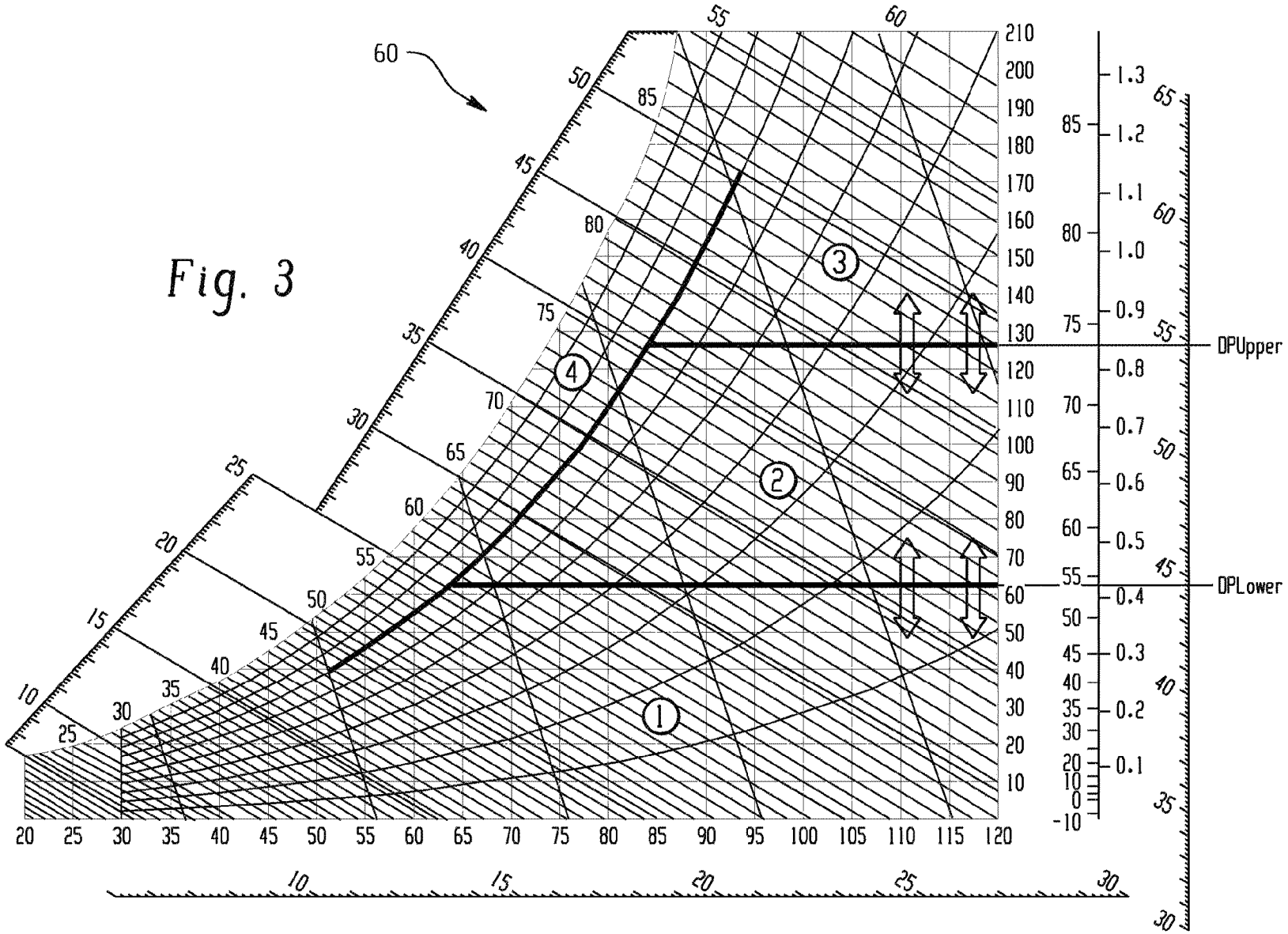
FIG. 3 is graph depicting an exemplary psychrometric chart that can be implemented by the device controller using data stored in memory.

Referring to FIG. 3, an exemplary psychrometric chart 60 is shown, where the chart defines four regions of operation 1, 2, 3 and 4. Data points defining this chart are stored in memory of the controller for access and use in order to define the logic used to control the perimeter heater(s). Region 4 represents a high relative humidity of the ambient environment (e.g., relative humidity >70%) and, in the exemplary embodiment, the control logic sets the perimeter heaters to full on when the ambient relative humidity falls in Region 4.

Region 3 represents conditions when the dew point temperature of the ambient environment is above a dew point temperature DPUpper, where DPUpper is representative of an upper limit temperature to which the perimeter heater(s) are capable of heating the outer surface of the perimeter of the cabinet opening, or some portion of the surface, when the heaters are full on (e.g., as determined during testing as described above). In a typical situation, the testing is carried out with the heaters full on and the lowest surface temperature detected on a portion of the surface of the perimeter (less a small tolerance factor) defines DPUpper. In Region 3, the selected control logic also sets the perimeter heaters to full on.

Region 1 represents conditions when the dew point temperature of the ambient environment is so low (e.g., below DPLower) that the occurrence of condensation is highly unlikely. DPLower is representative of a lower limit temperature of the outer surface of the perimeter of the cabinet opening, or some portion of the surface, when the perimeter heaters are full off (again, according to the testing). In Region 1, the selected control logic sets the perimeter heater to completely off or, alternatively, to some predefined minimum duty cycle.

Region 2 represents conditions where the dew point temperature of the ambient environment is below DPUpper and above DPLower. In Region 2, the selected control logic varies the duty cycle for energization of the perimeter heater(s) according to location within the region (e.g., lower in Region 2 results in a lower duty cycle and higher in Region 2 results in a higher duty cycle). As indicated above, in the past, the perimeter heater duty cycle (DHDutyCycle) has been varied according to the equation:

$$\text{DHDutyCycle}=(\text{DPRoomActual}-\text{DPLower})/(\text{DPUpper}-\text{DPLower}) \quad (1)$$

DPUpper and DPLower in Equation 1 are based upon testing that takes place at a reference ambient temperature and a reference cabinet set point temperature. However, deviation of the ambient environment from the reference ambient temperature and/or deviation of the operating cabinet set point temperature from the reference cabinet set point temperature can impact the actual need for heat to be applied by the perimeter heaters. In particular, the actual surface temperature of the opening perimeter will be higher if the cabinet set point temperature is higher than the reference cabinet set point temperature, and the actual surface temperature of the opening perimeter will be lower if the cabinet set point temperature is lower than the reference cabinet set point temperature. Similarly, the actual surface temperature of the opening perimeter will be higher if the actual ambient temperature is higher than the reference ambient temperature, and the actual surface temperature of the opening perimeter will be lower if the actual ambient temperature is lower than the reference ambient temperature. The controller 100 of the refrigerated device 10 incorporates control logic that accounts for such variances by providing corrections for both the cabinet set point temperature and the actual ambient temperature.

With respect to the correction for variance in cabinet set point temperature, the change in the actual cabinet set point temperature (TempCabSP) from the reference set point temperature (DHSPTempRef) is calculated and stored in a local variable fDeltaSP. If fDeltaSP is less than 1° F., no adjustment or correction is performed. If fDeltaSP is greater than 1° F., the perimeter heater set points are adjusted by an amount calculated by taking the fDeltaSP value and multiplying it by DHSPFactor per Equation 2 below, where DHSPFactor is unit-less and represents the change in temperature measured around the door perimeter per change in cabinet set point (TempCabSP). By way of example, if lowering the cabinet set point temperature by 1° F. will result in about 0.5° F. decrease in the lowest temperature measured around the perimeter of the cabinet opening, the DHSPFactor can be set to 0.5.

$$fDeltaSP=(TempCabSP-DHSPTempRef)\times DHSPFactor \quad (2)$$

With respect to the correction for variance in ambient temperature, the change in the current ambient temperature (TempRoom) from the reference ambient temperature (DH_AMBIENT_MEAS) is calculated per Equation 3 below and stored in a local variable fDeltaAMB. The perimeter heater set points are adjusted by an amount calculated by taking fDeltaAMB and multiplying it by DHAmbFactor. DHAmbFactor is unit-less and represents the change in temperature measured around the door perimeter per change in ambient temperature. By way of example, if an ambient temperature is 1° F. lower than the reference ambient temperature will result in about 1° F. decrease in the lowest temperature measured around the perimeter of the cabinet opening. DHAmbFactor may be set to 1.

$$fDeltaAMB=(TempRoom-DH_AMBIENT_MEAS)\times DHAmbFactor \quad (3)$$

The heater duty cycle (DHDutyCycle) for the heater element(s) when in Region 2 can then be calculated per Equation 4 below to account for the ambient temperature and cabinet set point variances.

$$DHDutyCycle=(DPRoomActual-DPLowerAdj)/(DPUpperAdj-DPLowerAdj), \quad (4)$$

where

DHDutyCycle is the energization duty cycle;

DPRoomActual is the determined dew point temperature for the ambient environment;

DPLowerAdj is the predefined lower dew point temperature DPLower adjusted, if necessary, by both a first amount based upon the temperature of the ambient air and a second amount based upon the set point temperature of the compartment, per Equation 5 below; and DPUpperAdj is the predefined upper dew point temperature DPUpper adjusted, if necessary, by both the first amount and the second amount per Equation 6 below.

$$DPLowerAdj=DPLower+fDeltaSP+fDeltaAMB \quad (5)$$

$$DPUpperAdj=DPUpper+fDeltaSP+fDeltaAMB \quad (6)$$

These adjustments for actual ambient temperature and actual cabinet set point effectively shift Region 2 upward or downward, at least for the purpose of calculating the appropriate heater energization duty cycle, when in Region 2. The DHDutyCycle value can then multiplied by a door heater duty cycle period to calculate the on duration for the perimeter heater element(s). For example, if the DHDutyCycle is 0.25 (25%), and the door heater duty cycle period is two minutes, the heater elements would be turned on for 30 seconds and off for 90 seconds for every two minute period. If the DHDutyCycle calculation exceeds 100%, then the logic defaults to 100% for the applied duty cycle.

It is to be clearly understood that the above description is intended by way of illustration and example only, is not intended to be taken by way of limitation, and that other changes and modifications are possible.

For example, other perimeter heater control logic processes could also be implemented in a manner to take into account how the actual ambient temperature and the actual cabinet set point temperature impact the temperature to which the perimeter heaters will heat the cabinet opening perimeter.

Moreover, rather than adjusting the energization duty cycle based upon the actual ambient temperature and the actual cabinet set point temperature, other techniques for adjusting the energization level of the heater element(s) could be implemented, such as be varying amplitude of the applied current. Both techniques effectively vary the energization level of the perimeter heater element(s) as a function of both the actual ambient temperature and the actual cabinet set point temperature.

Further, while a typical refrigeration system using an evaporator and fan to cool the refrigerated device compartment are shown above, alternative cooling systems for the compartment could be implemented.

What is claimed is:

1. A refrigerated device, comprising:

a compartment including an access door engageable with a perimeter of a compartment opening when the door is closed;

a cooling system for cooling the compartment to an actual set point temperature;

at least one sensor providing an output indicative of an actual temperature and a relative humidity of ambient air that surrounds the compartment;

at least one heater element associated with the perimeter of the compartment opening;

a controller operatively connected with the at least one sensor, the cooling system and the at least one heater element, wherein the controller is configured to:

determine a dew point temperature of the ambient air based on the actual temperature and the relative humidity of the ambient air; and define an operating energization level for the at least one heater element based at least in part upon each of (i) the determined dew point temperature, (ii) the actual temperature of the ambient air and (iii) the actual set point temperature of the compartment;

wherein the controller is configured to define the operating energization level by:

(a) accessing in memory a predefined upper dew point temperature and a predefined lower dew point temperature that correspond to a psychrometric chart region within which the determined dew point temperature falls; and (b) calculating an energization duty cycle for the at least one heater element according to the following equation:

$$DHDutyCycle=(DPRoomActual-DPLowerAdj)/(DPUpperAdj-DPLowerAdj),$$

where

DHDutyCycle is the energization duty cycle;

DPRoomActual is the determined dew point temperature;

DPLowerAdj is the predefined lower dew point temperature adjusted by both a first amount based upon the actual temperature of the ambient air and a second amount based upon the actual set point temperature of the compartment; and DPUpperAdj is the predefined upper dew point temperature adjusted by both the first amount and the second amount.

2. The refrigerated device of claim 1, wherein the controller is configured to operate the at least one heater element at the defined operating energization level without reference to an actual temperature of the perimeter of the compartment.

3. The refrigerated device of claim 1, wherein the first amount is a positive amount if the actual temperature of the ambient air is higher than a reference ambient temperature used to determine the predefined lower dew point temperature and the predefined upper dew point temperature, and the first amount is a negative amount if the actual temperature of the ambient air is lower than the reference ambient temperature.

4. The refrigerated device of claim 3, wherein the second amount is a positive amount if the actual set point temperature of the compartment is higher than a reference set point temperature used to determine the predefined lower dew point temperature and the predefined upper dew point temperature, and the second amount is a negative amount if the actual set point temperature of the compartment is lower than the reference set point temperature.

5. A refrigerated device, comprising:

a compartment including an access door engageable with a perimeter of a compartment opening when the door is closed;

a cooling system for cooling the compartment to an actual set point temperature;

at least one sensor providing an output indicative of a temperature and relative humidity of ambient air that surrounds the compartment;

at least one heater element associated with the perimeter of the compartment opening; and a controller operatively connected with the at least one sensor, the cooling system and the at least one heater element, wherein the controller is configured to:

define an operating energization level for the at least one heater element based at least in part upon the actual set point temperature of the compartment, wherein the operating energization level determines heat delivered by the at least one heater element to the perimeter of the compartment opening during heating of the perimeter of the compartment opening.

6. A method of controlling a heater element of a refrigerated device having a compartment including an access door engageable with a perimeter of a compartment opening when the door is closed and a cooling system for cooling the compartment to an actual set point temperature, wherein the heater element is positioned to heat a surface of the perimeter of the compartment opening to inhibit formation of condensation on the surface, the method comprising:

determining an actual temperature and a relative humidity of ambient air surrounding the refrigerated device;

determining a dew point temperature of the ambient air based upon the actual temperature and the relative humidity of the ambient air; and defining an operating energization level for the heater element based at least in part upon each of (i) the determined dew point temperature, (ii) the actual temperature of the ambient air and (iii) the actual set point temperature of the compartment, wherein the operating energization level determines heat delivered by the at least one heater element to the perimeter of the compartment opening during heating of the perimeter of the compartment opening.

7. The method of claim 6, further comprising:

energizing the heater element at the defined operating energization level without reference to an actual temperature of the surface of the perimeter.

8. The method of claim 6, wherein the step of defining the operating energization level involves:

(a) accessing in memory a predefined upper dew point temperature and a predefined lower dew point temperature that correspond to a psychrometric chart region within which the determined dew point temperature falls; and (b) calculating an energization duty cycle for the at least one heater element based upon each of (i) the determined dew point temperature, (ii) the actual temperature of the ambient air, (iii) the actual set point temperature of the compartment, (iv) the predefined upper dew point temperature and (v) the predefined lower dew point temperature.

9. The method of claim 8, wherein the step of calculating the energization duty cycle involves a calculation according to the following equation:

$$DHDutyCycle=(DPRoomActual-DPLowerAdj)/(DPUpperAdj-DPLowerAdj),$$

where

DHDutyCycle is the energization duty cycle;

DPRoomActual is the determined dew point temperature;

DPLowerAdj is the predefined lower dew point temperature adjusted by both a first amount based upon the actual temperature of the ambient air and a second amount based upon the actual set point temperature of the compartment; and DPUpperAdj is the predefined upper dew point temperature adjusted by both the first amount and the second amount.

10. The method of claim 9, wherein the first amount is a positive amount if the actual temperature of the ambient air is higher than a reference ambient temperature used to determine the predefined lower dew point temperature and the predefined upper dew point temperature, and the first amount is a negative amount if the actual temperature of the ambient air is lower than the reference ambient temperature.

11. The method of claim 10, wherein the second amount is a positive amount if the actual set point temperature of the compartment is higher than a reference set point temperature used to determine the predefined lower dew point temperature and the predefined upper dew point temperature, and the second amount is a negative amount if the actual set point temperature of the compartment is lower than the reference set point temperature.

12. The method of claim 6, wherein the step of defining the operating energization level involves:

(a) accessing in memory a predefined upper dew point temperature and a predefined lower dew point temperature that correspond to a psychrometric chart region within which the determined dew point temperature falls; and (b) calculating an energization current amplitude for the at least one heater element based upon each of (i) the determined dew point temperature, (ii) the actual temperature of the ambient air, (iii) the actual set point temperature of the compartment, (iv) the predefined upper dew point temperature and (v) the predefined lower dew point temperature.

* * * * *